US005707016A

United States Patent [19]

Witsken

[11] Patent Number: 5,707,016

[45] **Date of Patent: *Jan. 13, 1998**

[54] APPARATUS AND METHODS FOR WET GRINDING

[76] Inventor: Anthony Witsken, 4415 School Section Rd., Cincinnati, Ohio 45211

[ * ] Notice: The term of this patent shall not extend beyond the expiration date of Pat. No. 5,531,385.

[21] Appl. No.: 675,229

[22] Filed: Jul. 1, 1996

[51] Int. Cl.[6] ..... B02C 7/12

[52] U.S. Cl. ..... 241/46.06; 241/261.3

[58] Field of Search ..... 241/46.06, 261.2, 241/261.3, 297

[56] References Cited

U.S. PATENT DOCUMENTS

| | | |
|---|---|---|
| Re. 30,011 | 5/1979 | Seifert . |
| 254,814 | 3/1882 | Gathmann . |
| 2,064,666 | 11/1936 | Krushel . |
| 2,101,442 | 8/1937 | Martinez . |
| 3,214,104 | 10/1965 | Breuninger et al. . |
| 3,568,940 | 3/1971 | Merges . |
| 3,827,644 | 8/1974 | Johansson . |
| 4,036,443 | 7/1977 | Saltarelli . |
| 4,039,153 | 8/1977 | Hoffman . |
| 4,081,146 | 3/1978 | Yagi . |
| 4,082,233 | 4/1978 | Reinhall . |
| 4,129,263 | 12/1978 | Sjöbom . |
| 4,201,349 | 5/1980 | Walsh . |
| 4,253,613 | 3/1981 | Reinhall . |
| 4,269,365 | 5/1981 | Berggren . |
| 4,351,498 | 9/1982 | Laptev et al. . |
| 4,684,070 | 8/1987 | Dicky . |
| 4,684,071 | 8/1987 | Dicky . |
| 4,819,881 | 4/1989 | Sepke . |
| 4,927,088 | 5/1990 | Brewer . |
| 5,195,684 | 3/1993 | Radzins . |
| 5,531,385 | 7/1996 | Witsken ..... 241/21 |

FOREIGN PATENT DOCUMENTS

| | | |
|---|---|---|
| 3535245 | 4/1987 | Germany . |

*Primary Examiner*—John M. Husar
*Attorney, Agent, or Firm*—Wood, Herron & Evans, L.L.P.

[57] ABSTRACT

Wet grinding apparatus including a grinding unit having outer grinding discs and an inner rotating grinding disc. A drive shaft is attached to the rotatable disc and extends centrally through one side of the housing. The other side of the housing includes at least one central inlet port for allowing introduction of slurry solution. In an in-tank or batch grinder, inlet ports are provided on both sides of the housing through each outer disc. Inner surfaces of the outer discs and both surfaces of the rotatable disc have a series of outwardly extending grooves which taper in depth from a central location of each disc to a peripheral portion of each disc. Gap adjustment mechanisms are provided to separately adjust the gaps between the outer discs and the rotating discs. Spring based connections are provided between the outer discs to allow relative, biased movement.

22 Claims, 6 Drawing Sheets

APPARATUS AND METHODS FOR WET GRINDING

This application is related to U.S. patent application Ser. No. 08/058,410, filed on May 7, 1993, now U.S. Pat. No. 5,531,385, the disclosure of which is incorporated herein by reference.

BACKGROUND OF THE INVENTION

The present invention generally relates to apparatus for wet grinding and, more particularly, to the grinding of particles in a slurry solution down to particles having a size on the order of several microns or less.

Generally, size reduction of particles in a slurry is accomplished in multistage processes. That is, large particles of grain such as whole grain, corn, rice and the like, or other solids are initially broken down in size by conventional milling apparatus such as roll crushers, hammer mills, shredders and other similar devices depending on the product being ground. As one example, hammer mills may be suitable for use in dry grinding processes, wet grinding processes or both and may include a rotating cylinder or drum with attached "hammers" which crush particles against a stator screen. Hammer mills generally work under the principle of forcing particles through the holes in the stator screen to produce particles of a size commensurate with the size of the screen holes. Hammer mills are used in the distilling industry to dry grind grain which is later slurried with water in a separate tank to prepare the grain for fermentation. Disadvantages of hammer mills include the possibility of explosions resulting from the production of large amounts of dust, high maintenance costs associated with regular replacement of stator screens, and loss of product and damage to product from heat produced during the grinding process.

U.S. Pat. No. 4,813,617 ('617) issued on Mar. 21, 1989 to Knox, Jr. et al., which names the present inventor as a co-inventor thereof, addresses the problem of obtaining both maximum grinding efficiency and maximum throughput volume in a wet grinding machine. The '617 patent provides apparatus for very efficiently grinding large particles such as corn and the like down to smaller particles, for example, on the order of ⅛" in diameter, on a continuous high throughput volume basis. The '617 patent successfully accomplishes this objective by combining both large and small slots in a stationary stator and using a rotating bladed rotor disposed within the stator. Larger particles are reduced in size through shearing action between the blades of the rotor and the edges of the large slots in the stator and smaller particles are reduced in size through shearing action between the rotor blades and the small slots in the stator. Large particles are transferred out of the stator through the large slots and small particles are transferred out of the stator through both the large and small slots. The apparatus disclosed in the '617 patent presents a significant improvement over past grinding methods in terms of the size reduction and throughput volume potential of a single step grinding apparatus capable of reducing relatively large particles down to particles having an average diameter, for example, of ⅛".

Regarding apparatus and methods for reducing particles from a size on the order of ⅛" to a size of several microns or less, ball mills, hammer mills and homogenizers have been used in the past. Apparatus of this type have several undesirable features and cost implications. First, in order to obtain smaller and smaller particle sizes the holes in the stator screen or, for example, the balls or beads of a ball mill must be smaller to obtain smaller particle sizes. As the screen holes, balls or beads get smaller so to does the throughput volume of the grinding apparatus using these grinding or size reduction means. Thus, past fine grinding methods produce very low volumes of finely ground product.

Also, the costs associated with the manufacture, operation and maintenance of these machines are very high. For example, the costs associated with manufacturing minute openings in the screens used in a hammer mill are high especially when considering that the screens must be replaced constantly. The costs of manufacturing and maintaining a typical homogenizer are high due to the costs of the high pressure pumps, high powered motors and many other precision components.

Other problems have arisen using past methods to produce particle sizes on the order of several microns or less such as the undesirably long milling times, which may stretch up to 30 hours and which add to the costs of using ball mills, hammer mills and homogenizers. In the case of ball mills, due to the long milling time involved, these mills must be surrounded by cooling jackets which further add to their cost and complexity. Also, to change the output particle size, various component parts of these prior devices often must be accordingly changed and this further adds to cost and labor.

Accordingly, there is a need in the art for apparatus and methods for reducing the size of particles from sizes easily produced by apparatus such as that shown in the '617 patent, down to sizes on the order of several microns or less in a fast, efficient and size selectable manner by producing continuous high throughput volumes of dispersions and emulsifications containing such particles.

It has therefore been one objective of the invention to provide a wet fine grinder capable of continuously grinding particles contained in a slurry solution without clogging and without significant wear on the size reducing or grinding components of the apparatus.

It has been another objective of the invention to produce high throughput volumes of particles of a size on the order of several microns or less quickly and efficiently on a continuous in-line basis as opposed to a single batch basis.

It has been still another objective of the invention to significantly reduce the amount of time and number of grinding steps necessary to reduce large amounts of slurry solution containing relatively large particles into a slurry solution containing particles of several microns or less in size.

It has been yet another objective of the invention to provide apparatus for grinding particles in a batch of slurry contained in a tank as well as apparatus for grinding particles contained in slurry solution traveling in a fluid line and continuously recirculating slurry solution through each grinding apparatus.

It has been still a further objective of the invention to use the slurry solution itself as a lubricant and a coolant for the grinding components of the apparatus to substantially reduce wear on grinding components of the apparatus.

It has been still another objective to provide selective control of the output particle size without the need for changing component parts of the grinding device.

SUMMARY OF THE INVENTION

To these ends, the present invention provides at least two plates or discs having opposed flat surfaces and a plurality of outwardly extending grooves in each flat surface for containing and grinding particles in a slurry solution. At least one of the discs is rotated with respect to the other of the discs to facilitate size reduction of particles located in opposed grooves of different discs. The slurry preferably enters the spaces created by the grooves at a central inlet of one or more of the discs and is transferred to the periphery of the discs by centrifugal force created through rotation of at least one of the discs and by way of a pump in the case of an in-line unit discussed below. The slurry is then preferably recirculated to the central inlet to continuously circulate the slurry through the slots in the discs. In the preferred embodiments, the slots in the discs are tapered in depth along their length such that their deepest points are proximate the central inlet of the discs and their most shallow points are proximate the periphery of the discs. Furthermore, the grooves in each disc preferably end short of the periphery of the disc.

More particularly, a first preferred embodiment of the invention comprises an in-line grinding unit which includes a housing formed by two outer plates or discs. One of these outer discs includes an elevated land having a major face. A plurality of equally spaced grooves extend radially outwardly from a central slurry inlet port in the disc to a point proximate the outer periphery of the raised land.

A rotatable plate or disc includes similar grooves on both of its major faces and has a central threaded bore which allows the disc to be mounted to a rotatable drive shaft. This rotatable disc further includes feed openings spaced around and proximate to the central threaded bore. These feed openings extend through the rotatable disc from the first major face thereof to the second major face thereof and each feed opening communicates with an inlet end of one groove on the first major face and the inlet end of one groove on the second major face.

The second preferred embodiment of the present invention is very similar to the first embodiment in that two discs form a housing which contains a rotatable disc and each of the discs include grooves which interact with one another to provide a disintegrating action as well as a transfer path from central portions of each disc to at least one outlet in the outer periphery of the housing. In the second preferred embodiment, the grinding apparatus is submerged in a tank of slurry containing particles and the slurry is initially forced into the central inlet port by atmospheric pressure acting on the top surface of the slurry solution in the tank. The slurry solution that contains the particles is then drawn into and transferred along the grooves of each disc as a result of centrifugal forces created by the rotating disc. The particles in the slurry are disintegrated between the rotating disc and the discs which form the housing before the slurry exits through peripheral outlets in the housing. The slurry is thereby constantly recirculated from the tank into the central inlet port of the grinding unit, through the grooves in each of the discs, and back into the tank.

In a third embodiment of the invention, the second outer plate or disc includes a sump or collection container attached about the central inlet. The sump itself includes an inlet which may be attached to a suitable fluid line. This sump allows heavier or larger particles to fall to the bottom and smaller or lighter particles to circulate up to the central inlet port of the grinding unit. Eventually, the larger particles, depending on size, will slowly circulate up to the inlet port as well. As a further aspect which may be incorporated into the other embodiments as well, additional inlet fluid paths are provided to improve distribution of slurry material into the grinding unit. Specifically, the central drive shaft extends through the inlet and is bored out to a point adjacent the back side of the rotating disc where a plurality of radial bores extend through the drive shaft and communicate with the opposed grooves in the rotating disc and the first stationary disc. This creates a direct inlet fluid path to the back side of the rotating disc. In addition, a fluid path is provided into the grinding unit through an aperture in the third, stationary disc. A further aspect of the in-tank or batch grinder includes an inlet fluid path extending through the first stationary disc.

In another aspect of this invention, which also may be incorporated into any of the above embodiments, an adjustment feature provides selective control of the spacing between the various discs. Correspondingly, this allows selective adjustment of the output particle size. Also, a biased connection between the first stationary disc and second stationary disc allows slight movement of the second stationary disc in response to hydraulic pressure.

Each of the above described embodiments operate to grind slurry material on similar principles. That is, as the slurry material advances radially outwardly along the grooves, the particles are repeatedly reduced in size by shearing action between the advanced edge of one of the housing plates and the trailing edge of a groove in the rotating disc. Moreover, particles constantly collide with one another and are subjected to fluctuating pressures within the intermittently registering grooves of adjacent discs to cause further disintegration of the particles as they travel outwardly within the grooves. In addition, particles caught between the flat surfaces of the discs are reduced in size through a rolling action of the particles between the flat surfaces. If the particles are fibrous, then the fibers making up the particles are rolled into and compacted against each other to reduce the sizes of the particles.

As the particles are reduced in size, they travel radially outwardly along the grooves into shallower and shallower portions of the grooves and are finally reduced to sizes which are generally less than the distance between first and second flat surfaces of the rotating disc and the respective opposed flat surfaces of the outer housing plates or discs. After the particles have been ground, the slurry containing the particles exits the apparatus and may then be recirculated back to the inlet. In its preferred use, the invention is particularly applicable to the grinding of particles down to sizes of, for example, less than 5 microns. However, the apparatus may be dimensioned for grinding or disintegrating particles having greater diameters as well. This would merely require possibly changing the depth of the grooves and/or adjusting the spacing between the rotating disc and the stationary discs, such as by using the adjustment feature of this invention.

Further objects and advantages of the invention will become more readily apparent through the following detailed description taken in conjunction with the accompanying drawings.

DETAILED DESCRIPTION OF THE PREFERRED EMBODIMENTS

Figure 1:
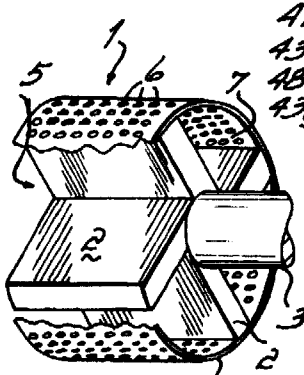
PRIOR ART FIG. 1
FIG. 1 is a partially fragmented perspective view of a conventional wet grinder used on a batch volume basis for reducing the size of particles contained in a slurry.

Before describing the preferred embodiments of the present invention, reference is first made to FIG. 1 which illustrates a conventional wet grinder 1 which is used in a batch of slurry material to reduce the size of particles contained in the slurry material. The wet grinder 1 includes a plurality of baffles 2 radially extending from the lower end of a drive shaft 3 and rotatably received in a circular screen structure 4. The screen structure 4 is typically held between upper and lower flanges (not shown). In operation, the wet grinder 1 is lowered into a batch of slurry material and the drive shaft 3 is rotated to draw slurry material into an inlet end 5 of the screen structure 4 through the lower flange (not shown). Once the slurry material is drawn into the screen structure 4, part of the material is forced through the screen openings 6. Many larger particles may not be able to be forced through the openings 6 in the screen structure 4 by the baffles 2. Also, devices such as the one shown in FIG. 1 reduce particles to a size which is limited by the size of the holes 6 in the screen structure 4 and, although the holes 6 may be formed in very small sizes through processes such as photoetching, by doing so the screen structure 4 becomes very fragile and easily subject to deformation. Moreover, problems related to clogged screen holes 6 and low throughput volume of ground slurry material often arise with devices of this type.

Figure 2:
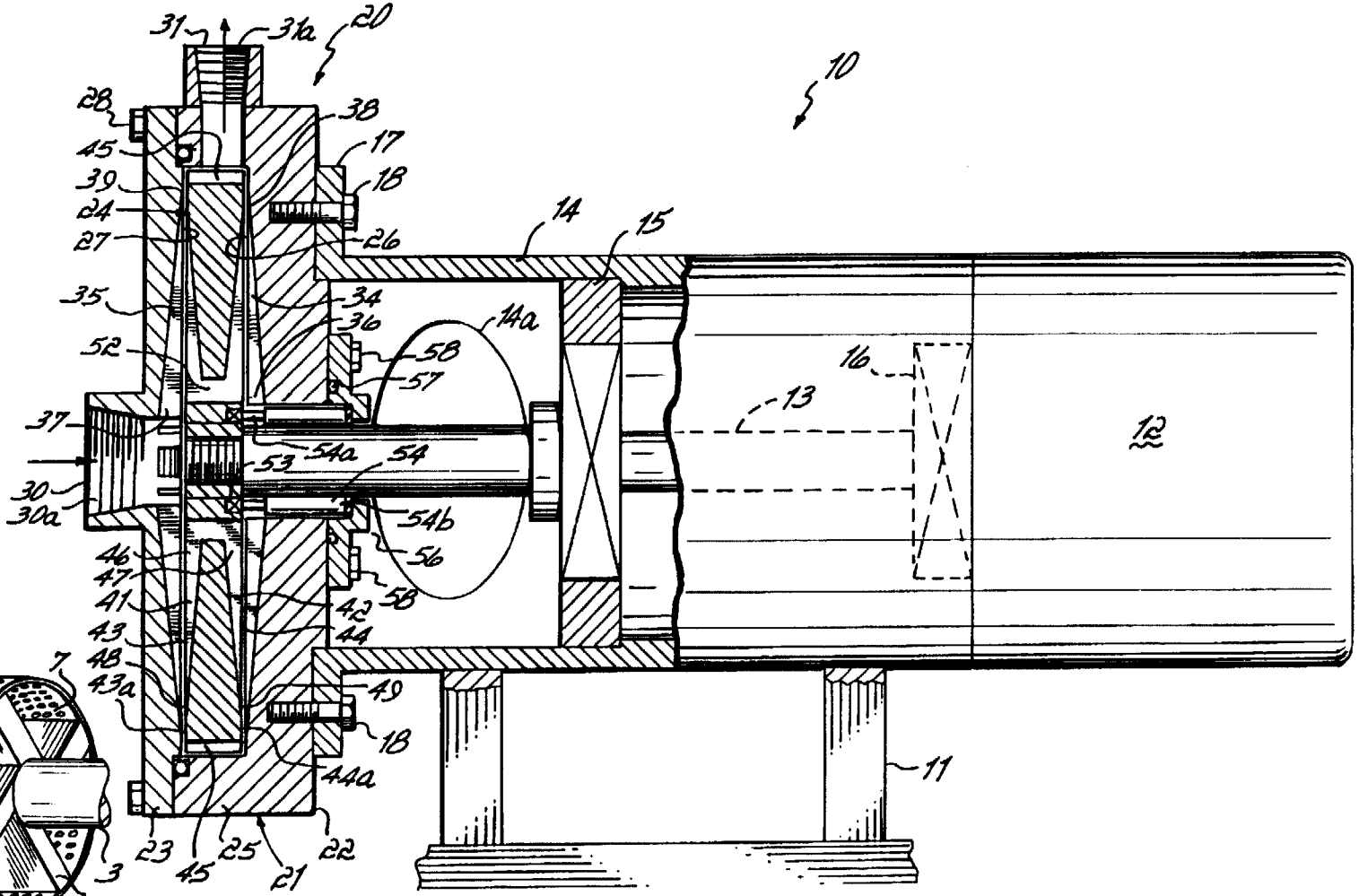
FIG. 2 is a partial cross-sectional side view of a first embodiment of the present invention showing an in-line wet grinding apparatus.

A first preferred embodiment of the present invention is illustrated in FIG. 2 and comprises an in-line wet grinding apparatus 10 having a mounting base 11 and a drive means in the form of a motor 12 directly coupled to a drive shaft 13. The drive shaft 13 extends along the longitudinal axis of the apparatus 10 inside a drive shaft housing 14. The drive shaft housing 14 includes an access port 14*a* for allowing maintenance to be performed on components within the housing 14. The drive shaft 13 is supported by bearing assemblies 15, 16 contained in the drive shaft housing 14. A flange portion 17 of the drive shaft housing 14 is located at one end thereof opposite the motor 12 and is attached by bolts 18 to a grinding unit 20.

Figure 3:
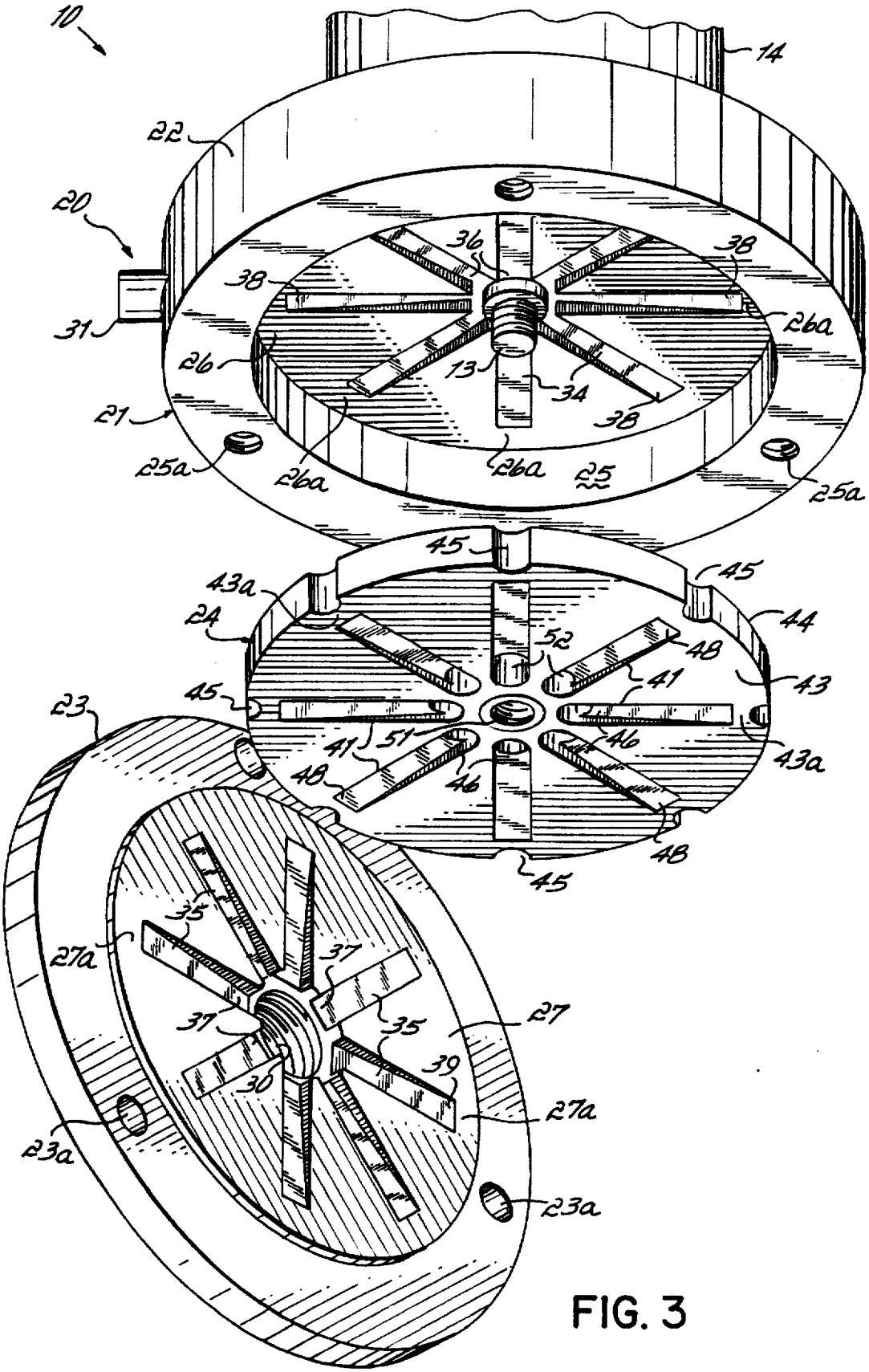
FIG. 3 is an exploded perspective view of the particle grinding or size reducing components of the apparatus shown in FIG. 2.

Referring now to both FIGS. 2 and 3, a preferred embodiment of the grinding unit 20 includes a grinding unit housing 21 having outer discs 22, 23 which together form an inner chamber which receives an inner rotary disc 24. One of the outer discs 22 includes a flange portion 25 which is connected to the other outer disc 23 by bolts 28 received in apertures 23*a* of disc 23 and threaded holes 25*a* in flange portion 25. The grinding unit housing 21 further includes a slurry inlet 30 and a slurry outlet 31. The slurry inlet 30 preferably extends through the center of disc 23 and the slurry outlet 31 extends through the flange portion 25 of disc 22. The slurry inlet 30 and slurry outlet 31 may vary in size according to the flow requirements of the particular grinding operation. The slurry inlet 30 and slurry outlet 31 have respective female threaded portions 30*a*, 31*a* for connecting fittings and fluid lines thereto. Of course, male threaded portions or other connecting means, such as quick-connect fittings, may be substituted for the female threads shown.

As previously mentioned, the outer discs 22, 23 preferably form a housing or stator within which the inner rotary disc 24 rotates. The inner surfaces 26, 27 of each respective outer disc 22, 23 contain a series of grooves 34, 35. As shown best in FIG. 2, each groove 34, 35 preferably tapers in depth from a respective inlet end 36, 37 to a respective outlet end 38, 39. Each of the grooves 34, 35 are deeper at their respective inlet ends 36, 37 than at their respective outlet ends 38, 39. The inlet ends 37 of each of the grooves 35 in disc 23 communicate with the slurry inlet 30 at the center of disc 23.

As further shown in FIG. 2, the rotary disc 24 includes a series of tapered grooves 41, 42 in both of its major faces 43, 44. The grooves 41, 42 extend from respective inlet ends 46, 47 to respective outlet ends 48, 49. Notches 45 are formed in the peripheral edge surface of the rotary disc 24 and each notch 45 is in line with the outlet ends 48, 49 of two parallel grooves 41, 42 in opposite sides 42, 43 of the rotary disc 24. Like the grooves 34, 35 in discs 22 and 23, the grooves 41, 42 are each preferably tapered such that they are deeper at their respective inlet ends 46, 47 than at their respective outlet ends 48, 49.

A central threaded aperture 51 of disc 24 allows a threaded end of the drive shaft 13 to be attached to the rotary disc 24. The drive shaft 13 preferably rotates the inner disc 24 at a speed which is preferably in excess of 1000 rpm and may be, for example, 3450 rpm in a direct couple system between the motor 12 and the drive shaft 13. Of course, the actual speed will depend on the viscosity of the liquid containing the particles and/or the overall viscosity of the slurry solution. An annular pattern of spaced feed openings 52 are formed about the periphery of the drive shaft mounting aperture 51. Each feed opening 52 communicates with one inlet end 46 of a groove 41 on one side of the rotary disc 24 and one inlet end 47 of a groove 42 on the other side of the rotary disc 24. These feed openings 52 allow slurry solution to be introduced into the inlet 30 of disc 23 and fed from the grooves 35 in disc 23 into the grooves 42 in the rotary disc 24 which face away from the inlet 30 as well as the grooves 34 in disc 22.

A mechanical liquid seal is provided to keep the slurry solution within the grinding unit 20 and includes a rotary seal member 53 which is preferably formed of a ceramic material. The rotary seal member 53 is recessed into and rigidly attached to the rotary disc 24 intermediate the central drive shaft opening 51 and the spaced feed openings 52. A second spring loaded seal component 54 is held against the rotary component 53 by a mounting bracket 56 having an O-ring 57 in a lower surface thereof. The bracket 56 is fastened to outer disc 22 by a plurality of bolts 58. Thus, liquid seals are created between the rotary seal member 53 and the lower portion 54*a* of the spring loaded seal component 54, between the top portion 54*b* of the spring loaded seal component 54 and the bracket 56, and between the O-ring 57 and the outer surface of disc 22. One suitable seal assembly is marketed by Garlock Mechanical Packing Division, Mechanical Seals, a division of Colt Industries, under PK Form No. 70-20B.

Figure 4:
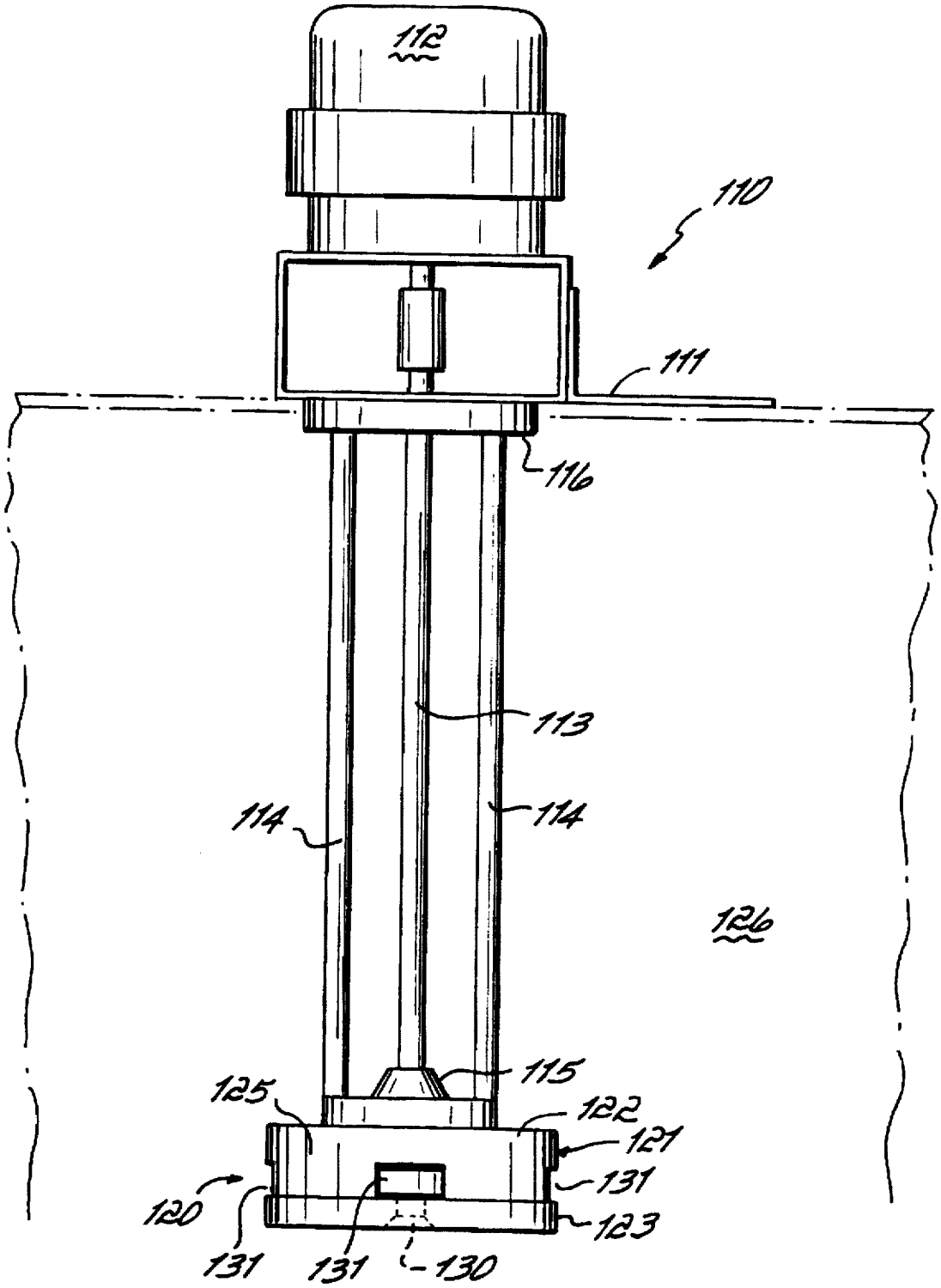
FIG. 4 is an elevated side view of a second embodiment of the present invention showing an in tank wet grinding apparatus.

A second embodiment of the invention is shown in FIG. 4 and comprises an in-tank grinding apparatus 110 mounted by a suitable bracket 111 to a tank of slurry solution 126. The grinding apparatus 110 includes a motor 112 at an upper end thereof operatively connected to a rotating drive shaft 113. Like the drive shaft 13 of the first embodiment, the drive shaft 113 is supported by suitable bearing assemblies 115, 116. At the lower end of the drive shaft 113, the grinding apparatus 110 includes a grinding unit 120 formed by a housing having outer plates or discs 122, 123.

There are only two significant differences between the in-line design shown in FIGS. 2 and 3 and the in-tank design shown in FIG. 4. One difference is that the in-tank grinding apparatus 110 includes elongated support rods 114 in place of a drive shaft housing. These elongated support rods 114 extend substantially between the motor 112 and the grinding unit 120 and are sized according to the depth of the tank in which the grinding apparatus is intended to be used. Thus, the drive shaft 113 and the support rods 114 are of a length which allows the motor 112 to be positioned above the top surface of the slurry material 126 and the grinding unit 120 to be positioned near the bottom of the tank of slurry solution.

The other difference between the first two embodiments resides in the fact that a plurality of outlet ports 131 are formed in the flange portion 125 of disc 122 as opposed to a single outlet port. The use of a plurality of outlet ports 131 allows ground slurry to exit the grinding unit 120 in greater volumes than would a single outlet port. This allows slurry to be more quickly recirculated back to the inlet port 130 of the grinding unit 120 and further increases the volume of slurry moving through the grinding unit 120. Except for the use of a plurality of outlets 131, the inner design of the grinding unit 120 including the grooves (not shown) in the inner faces of the outer discs 122, 123 and the design of the grooved rotary disc (not shown), is identical to the design of the like components in the grinding unit 20 including discs 22, 23 and 24 shown in FIGS. 2 and 3 and described in detail above. This detail therefore need not be repeated in the description of the second embodiment.

Figure 5:
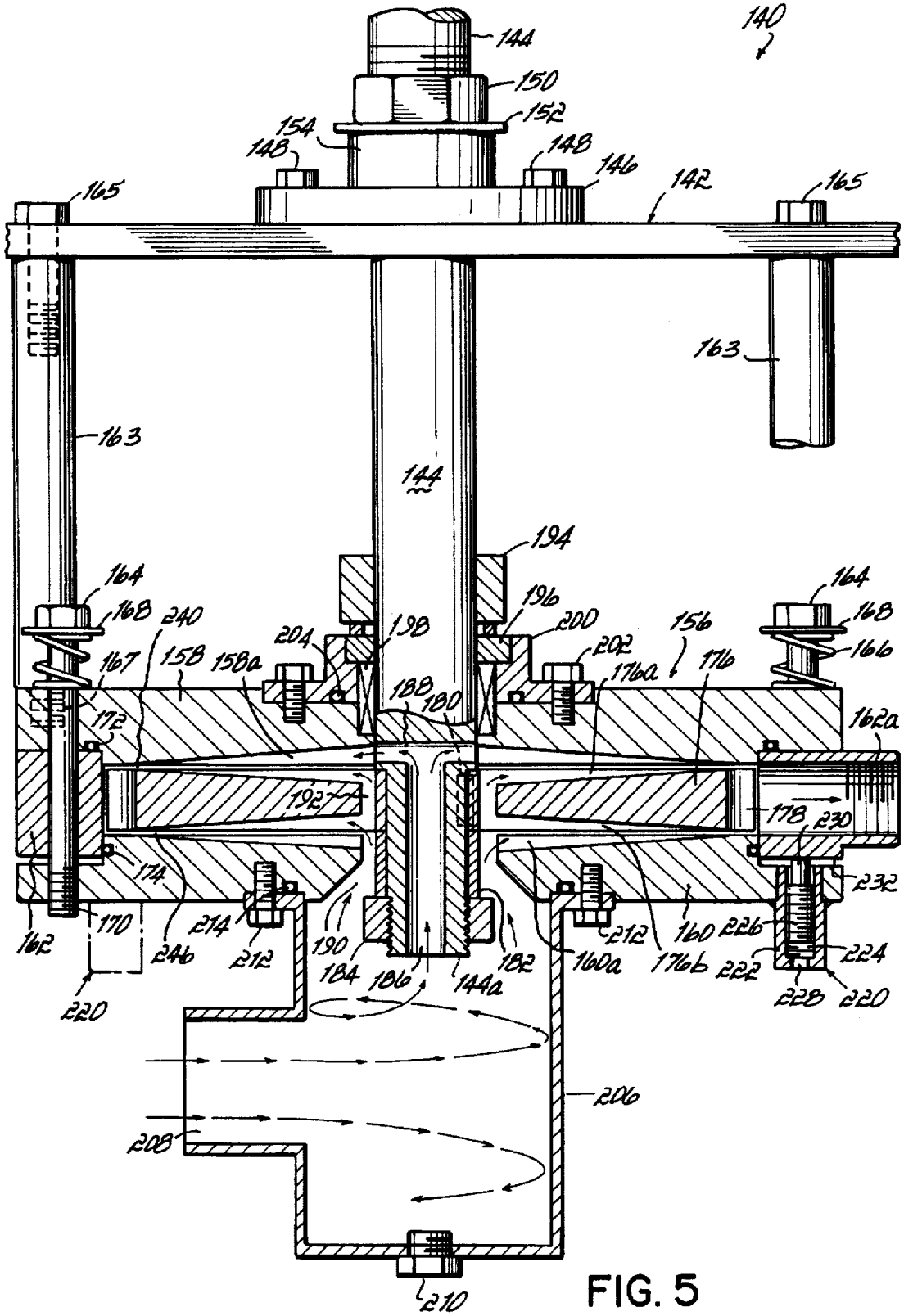
FIG. 5 is a partially cross-sectioned view similar to FIG. 2 but eliminating the motor and support structure for clarity and showing a third embodiment of the invention.

FIG. 5 shows a third embodiment which is an alternative embodiment of an in-line grinder 140. Grinder 140 is set up to be used in a vertical orientation rather than the horizontal orientation shown in FIG. 2. Grinder 140 includes suitable support structure 142 for facilitating this vertical orientation, although, most of this support structure 142 has been broken away for clarity. A central drive shaft 144 is rotated by a motor (not shown) as in the first embodiment. Drive shaft 144 extends through a flange bearing assembly 146 which is fastened to support structure 142 by suitable bolts 148. A fine threaded nut 150 threads onto shaft 144 against a washer 152 and bearing 154.

Shaft 144 extends down into a grinding unit 156 which is very similar to the first embodiment. Like the first embodiment, grinding unit 156 includes opposed stator or stationary discs 158, 160 each having tapered grooves **158*a*, 160*a*. Stationary discs 158, 160 are fastened to one another with an annular ring 162 disposed therebetween. Connecting rods 163 are mounted between support structure 142 and disc 158 by bolts 165 and threaded ends 167. Bolts 164 fasten stationary discs 158, 160 together and extend through annular ring 162. Annular ring 162 includes an outlet 162*a*. Springs 166 are disposed between washers 168 associated with the heads of bolts 164 and stationary disc 158. In the embodiment shown, the springs 166 have a wire diameter of 0.062 in. and may be one inch in length. The springs 166 allow lower stationary disc 160 to move back and forth slightly in an axial direction with respect to shaft 144 under hydraulic pressure within grinding unit 156. Another main function of springs 166 is to allow stationary disc 160 to adjust to the gap setting, to be described below, as well as to ensure uniform spacing between the discs. Bolts 164 have threaded ends 170 which thread into lower stationary disc 160. O-rings 172, 174 provide respective seals between discs 158, 160 and annular ring 162**.

Also, as in the first embodiment, a rotating disc or rotor 176 rotates with shaft 144 to facilitate the grinding operation. Disc 176 includes tapered grooves **176*a*, 176*b* just as in the first embodiment respectively facing grooves 158*a* and 160*a*. Notches 178 are provided in the periphery of disc 176 for pumping and carrying ground slurry material to outlet 162*a*. Rotating disc 176 is connected rigidly to a lower reduced end 144*a* of shaft 144. Specifically, a key 180 is affixed between shaft portion 144*a* and disc 176. A spacer 182 is tightened between rotating disc 176 and a nut 184 threaded onto lower shaft end 144*a***.

The reduced lower end **144*a* of shaft 144 includes a central bore 186 extending upwardly approximately to the area of grooves 158*a*, 176*a*. A plurality of radially extending bores 188 connect with central bore 186 and communicate with the inlets to grooves 158*a*, 176*a*. An opening 190 is also formed centrally in disc 160 and centrally receives lower shaft portion 144*a*. Like the first embodiment, a plurality of feed apertures 192 extend in an annular pattern through rotating disc 176 about lower shaft portion 144*a*. This annular pattern of feed holes 192 also allows slurry to reach grooves 158*a* and 176*a* after it enters annular opening 190**.

A rotating seal 194 connects with shaft 144 above stationary disc 158 and rotates in a sealing manner against a seat 196. Mounted below seat 196 is a bearing 198 for shaft 144. Seat 196 and bearing 198 are both mounted within a flange 200 secured to stationary disc 158 by suitable bolts 202. An O-ring 204 provides a seal between flange 200 and upper stationary disc 158.

A sump or collection container 206 is mounted to lower stationary flange 160 about lower shaft portion **144*a* and annular inlet 190. Sump 206 includes an inlet 208. Inlet 208 may be formed tangentially on sump 206, especially when sump 206 is formed as a cylindrical container. This tangential inlet 208 will create a swirling action within sump 206 to aid in the distribution of particles to inlet 190 and central bore 186 of grinding unit 156. Sump 206 includes a drainage plug 210 and is affixed to includes a drainage plug 210 and is affixed to lower stationary disc 160 by bolts 212. An O-ring 214 provides a seal between sump 206 and lower stationary disc 160**.

Lower stationary disc 160 further includes a plurality of, for example, four gap adjusters 220 equally spaced thereabout. Gap adjusters 220 each comprise a cylindrical hollowed out member 222 welded into lower stationary disc 160 generally at a peripheral location. Cylindrical member 222 includes a threaded interior 224 which receives an adjustment screw 226 for threaded movement therein. An access hole 228 is provided in a lower end of cylindrical member 222. Hole 228 is formed with a smaller diameter than adjustment screw 226. This helps prevent losing screws 226 while providing a large enough access for a tool, such as an Allen wrench. Adjustment screw 226 includes an upper reduced diameter end 230 which bears against an underside 232 of annular ring 162.

Figure 6:
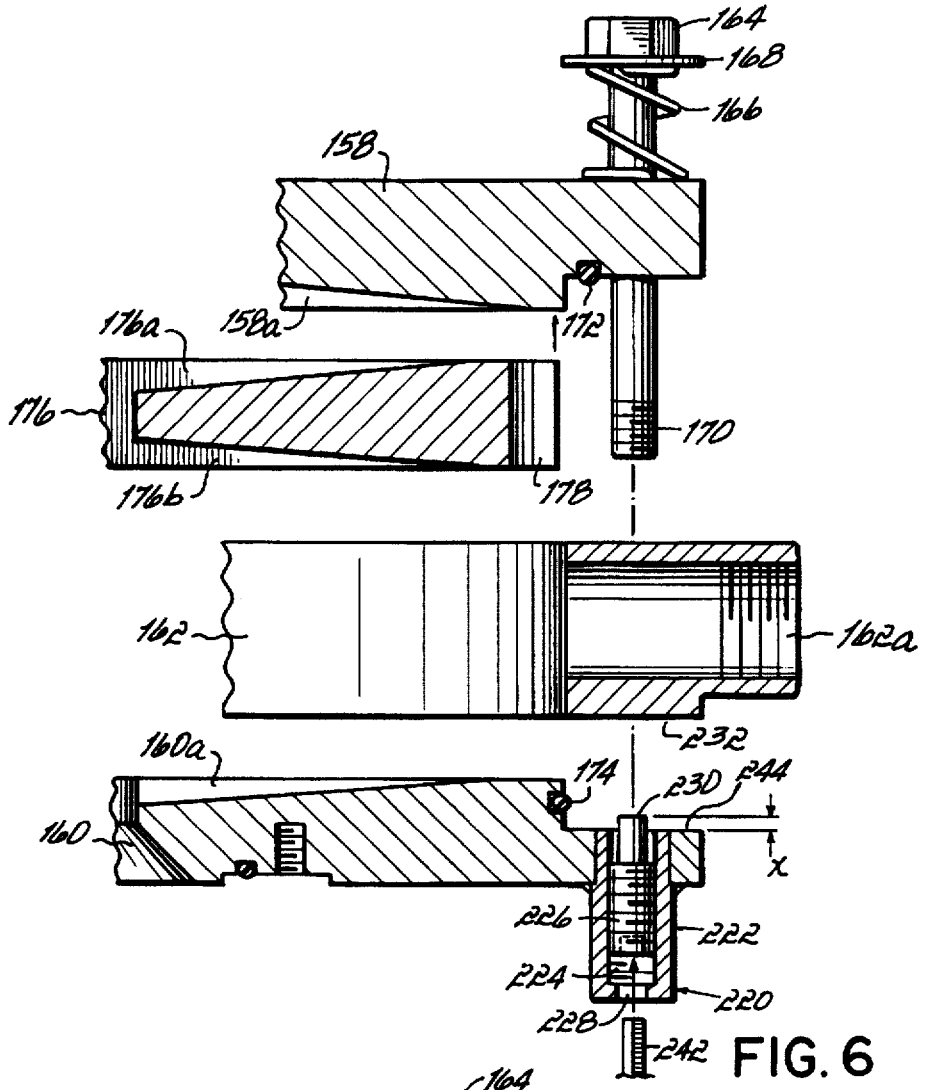
FIG. 6 is a fragmented and exploded view showing connection and adjustment structure of the discs illustrated in FIG. 5.
Figure 7:
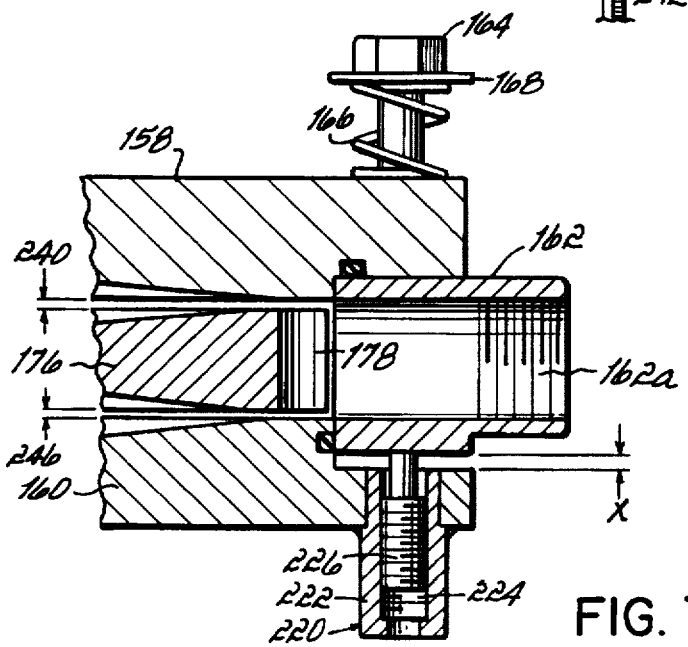
FIG. 7 is a fragmented cross-sectional view similar to FIG. 6 but showing the various elements connected together.

The adjustable connection which is made between stationary discs 158, 160, annular ring 162 and rotating disc 176 may be best understood with reference to FIGS. 5–7. FIGS. 6 and 7 first, with reference to FIG. 5, the gap between stationary disc 158 and rotating disc 176 is set before lower stationary disc 160 and annular ring 162 have been connected to upper stationary disc 158. Therefore, with upper stationary disc 158 connected to rods 163 and rotating disc 176 connected to shaft 144, a gap 240 is accessible between stationary disc 158 and rotating disc 176. Thus, one or preferably multiple feeler gauges or specifically sized pieces of shim stock of the desired thickness may be inserted in gap 240. With a feeler gauge or shim stock inserted in gap 240, nut 150 is tightened until the feeler gauge or shim stock is contacted on each side.

Referring now to FIG. 6, gap adjusters 220 are set on lower stationary disc 160. With lower stationary disc 160 preferably detached from the rest of the assembly, set screws 226 are turned with an Allen wrench 242 until reduced diameter portion 230 is exposed above surface 244 of lower stationary disc 160. Reduced diameter portion 230 may be exposed above surface 244 a distance "x", which corresponds to twice the desired particle size. Although other methods may be employed, referring to FIG. 7, distance "x" is equal to the gap 240 created between upper stationary disc 158 and rotating disc 176 added to the gap 246 created between lower stationary disc 160 and rotating disc 176. With all of the gap adjusters 220 set as shown in FIG. 6, annular ring 162 and then lower stationary disc 160 are affixed in place using bolt assemblies 164, a shown in FIG. 7. As mentioned above, shim stock may also be used to help set this gap.

Figure 8:
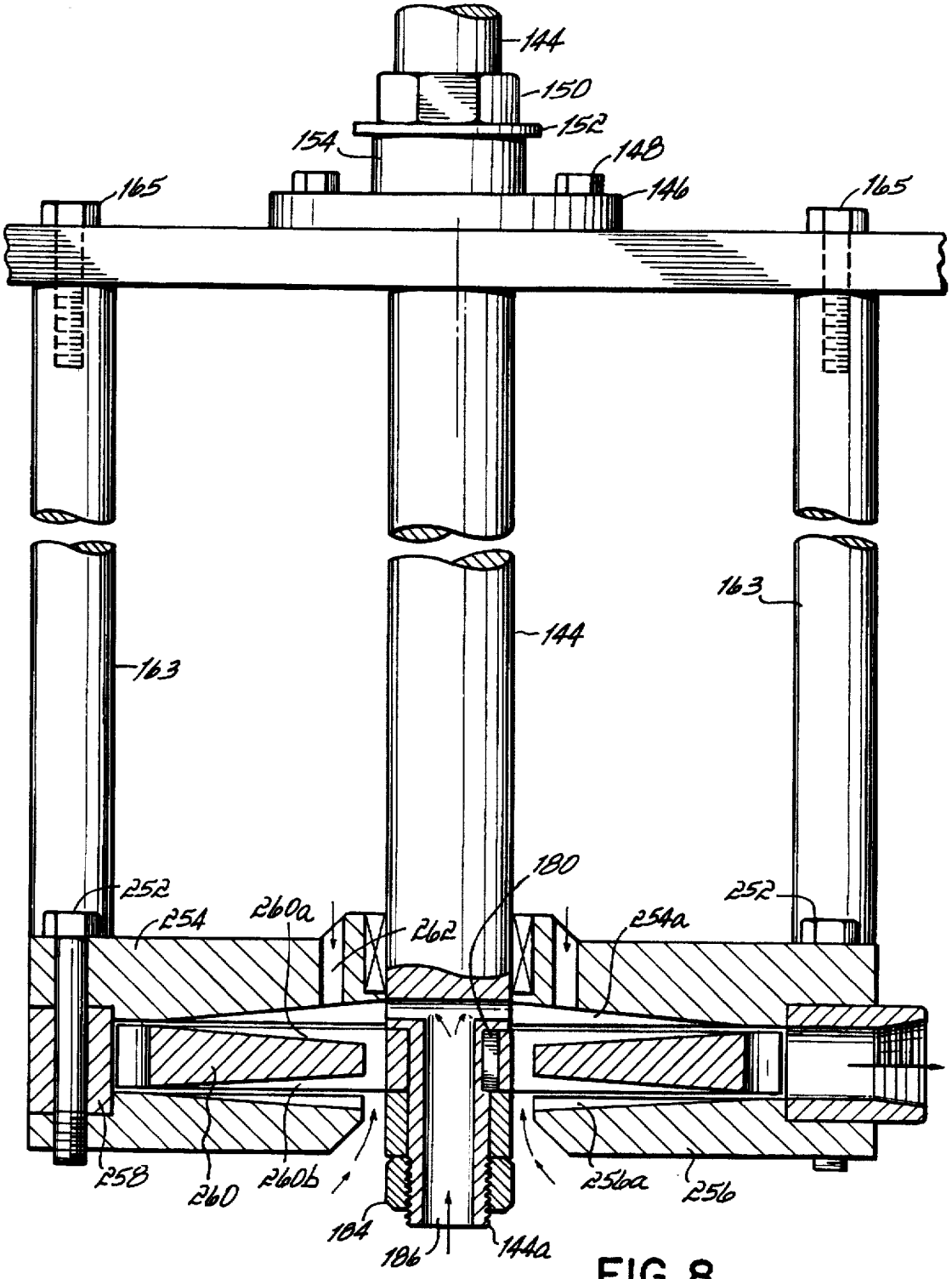
FIG. 8 is a partially cross-sectioned view similar to FIG. 5 but showing an alternative embodiment of an in-tank wet grinding apparatus according to the invention.

FIG. 8 illustrates an alternative embodiment to the in-tank design shown in FIG. 4. Specifically, an in-tank grinder 250 is shown with like reference numerals indicating like parts with in-line grinder 140 shown in FIG. 5. In-tank grinder 250 is shown without bolt assemblies 164 and gap adjusters 220 of the in-line grinder 140. It will be appreciated that these features may also be incorporated into grinder 250. Grinder 250 is simply shown with bolts 252 securing upper stationary disc 254, lower stationary disc 256, annular ring 258 and rotating disc 260. As with each of the other embodiments, upper stationary disc 254, lower stationary disc 256 and rotating disc 260 each include respective tapered grooves **254*a*, 256*a* and 260*a*, 260*b*. The main differences between in-tank design 250 and in-line design 140 are that the sump 206 (FIG. 5) has been eliminated and additional inlets 262 have been formed through upper stationary disc 254 to communicate with grooves 254*a* and 260*a*. Inlets 262 may be angularly spaced about drive shaft 144. Inlets 262 provide additional input of slurry material for achieving greater productivity. It will also be understood that in this embodiment, shaft 144 and rods 163 may be formed in any length necessary such that in-tank grinder 250 may be used in a batch of slurry material similarly to that shown in FIG. 4**.

Operation of the in-line grinders 10 and 140 is generally the same but will be described with specific reference to FIG. 2. Slurry solution containing particles enters the grinding unit 20 through the inlet port 30 by way of a fluid line (not shown) connected to the inlet port 30. The slurry solution is then drawn into the grooves 35 of disc 23 by the partial vacuum or negative pressure created by centrifugal forces of the rotating disc 24. The slurry solution also enters the feed apertures 52 in the rotating disc 24 and thereby reaches the series of grooves 42 in the rotating disc 24 as well as the series of grooves 34 in disc 22. The maximum initial size of the particles in the slurry solution entering the grinding unit 20 is limited by the maximum combined depth of a groove 35 in disc 23 and a groove 41 in the rotary disc 24 added to the distance between faces 27, 43 of discs 23, 24, respectively. Likewise, the maximum initial particle size is also limited to the maximum combined depth of a groove 34 in disc 22 and a groove 42 in the rotary disc 24 added to the distance between faces 26, 44 of discs 22, 24, respectively. The feed openings 52 are also formed large enough to allow transfer of the maximum size of particles as defined above to prevent blockage of the feeding openings 52 by oversized particles. The slurry solution is preferably run through a classifier prior to entering the grinding unit 20 in order to filter out particles larger than the maximum initial size which may be effectively processed by the grinding unit 20. Of course, the dimensions of the outer discs 22, 23, the inner rotary disc 24, the grooves 34, 35, 41, 42 in each disc, and the feed openings 52 may be varied according to the specific grinding needs and the particular slurry material to be ground.

Once the slurry solution is transferred into grooves 34, 35, 41 and 42, the slurry solution is transported outwardly within the grooves 34, 35, 41 and 42, through centrifugal force created by the rotating disc 24. As the slurry solution is transported along the tapered grooves 34, 35, 41 and 42, the particles in the slurry solution are continuously ground and disintegrated at least until they reach a maximum size which is defined by the distance between the major surfaces 43, 44 of the rotary disc 24 and each respectively opposed inner surface 26, 27 of the outer discs 22, 23. This maximum size results because each of the grooves 34, 35, 41 and 42 tapers up to the respective surfaces 26, 27, 43 and 44 a short distance inside of the peripheral edges of these surfaces 26, 27, 43 and 44. Thus, small surface areas **26*a*, 27*a*, 43*a* and 44*a* are left outside the outlet ends 38, 39, 48 and 49 of the respective grooves 34, 35, 41 and 42. The distance between surfaces 26 and 44 as well as the distance between surfaces 27 and 43 therefore essentially govern the maximum output particle size. The maximum output particle size may therefore be controlled by varying these distances through specific dimensioning of the apparatus. The distance between surfaces 27 and 43 and surfaces 26 and 44 may each be, for example, 0.010" and the grinding unit 20 will still produce particles on the order of several microns or less to achieve extremely find grinding of particles in a slurry solution. Thus, it will be appreciated that the plates or discs 22, 23, 24 need not be spaced apart by 5 microns to obtain particles of 5 microns, for example. The combined effects of the high speed rotation of at least one disc, the shearing effects of the tapered grooves, and the high speed collisions between particles cause the particles to be disintegrated to a size smaller than the spacing between the flat surfaces 26, 27, 43, 44 of the respective discs 22, 23, 24**.

Separate cooling means are generally not necessary since the slurry solution itself acts as a lubricant and coolant as it flows through the grinding unit 20. Of course, a cooling jacket may be used around the grinding unit 20 if necessitated by a particular grinding operation.

When the slurry solution reaches the outer peripheral edge of the rotary disc 24, the slurry solution is transferred along the inner edge of flange portion 25 of disc 22 to the outlet port 31 by notches 45 in the rotary disc 24. In this regard, the notches 45 in the rotary disc 24 provide a pumping action, similar to a centrifugal pump, to continuously feed slurry material through the outlet port 31. To provide a continuous grinding or disintegration action, the outlet port 31 may be connected by suitable fluid lines and fittings to a slurry supply and back to the inlet port 30 such that the slurry solution in the supply is continuously recirculated through the grinding unit 20. Alternatively, the inlet port 30 may be connected to a slurry supply and the outlet port 31 may be connected to a separate receiving tank.

The operation of the in-tank grinding apparatus 110 and 250 shown, respectively, in FIGS. 4 and 8 is very similar to the operation of the in-line grinding apparatus 10 and 140. With respect to FIG. 4, and correspondingly applicable to grinder 250, the only significant difference is that the grinding unit 120 is placed into a batch of slurry material 126. Slurry material is constantly forced into the inlet 130 of the grinding unit 120 (or inlets 190 in grinder 140 and 262 in grinder 250) by atmospheric pressure exerted against the top surface of the slurry material 126. The slurry material travels into the grinding unit 120 and the particles in the slurry are ground or disintegrated in a manner identical to that described above with reference to FIG. 2. However, rather than being transferred out of the grinding unit 120 through a single outlet port, the slurry material preferably exits the grinding unit 120 through several outlets 131. The slurry material 126 contained in the tank is constantly recirculated through the grinding unit 120 until substantially all of the slurry material 126 in the tank has passed through the grinding unit 120.

Although preferred embodiments of the present invention have been shown and described above, one of ordinary skill will readily recognize numerous modifications thereto. For example, although the grinding units are shown to include a rotary disc having grooves on both sides thereof and outer plates each having inner grooves opposing the grooves in the rotary disc, the grinding unit could readily be modified into a two disc system having one series of grooves on each disc in opposed relation. Also, although metal such as stainless steel is preferred as a material of construction, plastic may be substituted for components such as the grinding discs depending on the application.

The grinding unit may be designed with suitable multiple drive shaft and/or gear systems such that more than one of the discs are rotated at one time. For example, the grinding unit could be design using conventional drive mechanisms such that adjacent discs rotate in opposite directions so as to increase the difference in their relative speeds and thereby increase the resulting particle disintegration. In addition, the design of the grooves in the various discs may be varied by, for example, extending their lengths by forming them in patterns other than the radially extending patterns shown and described herein. One alternative is to form them shaped as curves extending from their inlet ends to their outlet ends. The grooves may be tapered in width as well as depth from an inlet end to an outlet end thereof, for example, such that they are wider at the inlet end. For coarser grinding applications, the grooves may be left untapered in depth. Finally, the grooves may have concavely shaped bottom surfaces as opposed to flat bottom surfaces as shown. This would, for example, prevent buildup of slurry material in the grooves.

Other modifications will become readily apparent to the artisan of ordinary skill and applicant intends to be bound only by the scope of the appended claims.

I claim:

1. Wet grinding apparatus comprising:

first and second discs, each disc having two faces wherein a face of said first disc is in opposed relation to a face of said second disc thereby defining a first pair of opposed faces, a plurality of grooves in each face of said first pair of opposed faces, a drive shaft connected to the second disc for rotating the second disc;

a first fluid inlet path extending through said drive shaft and leading to the grooves in said first pair of opposed faces for introducing a slurry material containing particles into said grooves of said first pair of opposed faces, and an outlet for allowing said slurry material to exit said grooves.

2. The wet grinding apparatus of claim 1 further comprising a third disc and a second fluid inlet path extending through said third disc, wherein the first and third discs define outer discs having a plurality of grooves in inner faces thereof and said second disc defines an inner disc disposed between said first and third discs and includes grooves in both faces thereof, said second fluid inlet path leading to opposed grooves in said second and third discs.

3. The wet grinding apparatus of claim 2 further comprising a collection container having an open end connected to the third disc about the first and second fluid inlet paths and further including an inlet for introducing said slurry material to said collection container.

4. The wet grinding apparatus of claim 2 wherein the second fluid inlet path includes an inlet opening disposed generally about one end of said drive shaft.

5. The wet grinding apparatus of claim 4 further comprising a plurality of radially spaced apertures centrally located in said second disc and creating additional fluid paths between said first and second fluid inlet paths.

6. The wet grinding apparatus of claim 2 further comprising a third fluid inlet path extending through the first disc and leading to the first pair of opposed faces.

7. The wet grinding apparatus of claim 1 wherein another fluid inlet path extends through the first disc and leads to the first pair of opposed faces.

8. Wet grinding apparatus comprising:

first, second and third discs, said second disc being disposed between said first and said third discs and each disc having two faces wherein the two respective faces of said second disc are in opposed relation to one face of said first disc and one face of said third disc, a plurality of grooves in each face of said second disc and the faces of said first and third discs which are in opposed relation to the faces of said second disc, at least one inlet for introducing a slurry material containing particles into the grooves of said first, second and third discs, an outlet for allowing the slurry material to exit the grooves in said first, second and third discs, a drive shaft connected to rotate the second disc, support structure connected to said drive shaft, a first gap adjustment mechanism connected with said support structure and operable to vary the distance between the first and second discs, and a second gap adjustment mechanism connected to said third disc and operable to vary the distance between the second and third discs.

9. The wet grinding apparatus of claim 8 wherein the first gap adjustment mechanism includes an adjustment nut threaded onto said drive shaft and operable to move said drive shaft and said second disc axially with respect to said support structure and said first disc.

10. The wet grinding apparatus of claim 9 wherein the second gap adjustment mechanism includes a plurality of adjustment screws connected to the third disc and operable to move the third disc axially with respect to the second disc.

11. The wet grinding apparatus of claim 8 wherein the second gap adjustment mechanism includes a plurality of adjustment screws connected to the third disc and operable to move the third disc axially with respect to the second disc.

12. The wet grinding apparatus of claim 11 wherein each adjustment screw is movable in a threaded bore extending through the third disc, said bore opening toward the first disc for allowing an end of the adjustment screw to extend through the bore and at least indirectly bear against the first disc.

13. The wet grinding apparatus of claim 12 wherein the threaded bore is contained in a housing extending through the third disc, said housing including an access hole for allowing a tool to engage the adjustment screw received therein.

14. The wet grinding apparatus of claim 13 wherein the access hole is dimensioned smaller than the diameter of said adjustment screw.

15. Wet grinding apparatus comprising:

first, second and third discs, said second disc being disposed between said first and said third discs and each disc having two faces wherein the two respective faces of said second disc are in opposed relation to one face of said first disc and one face of said third disc, a plurality of grooves in each face of said second disc and the faces of said first and third discs which are in opposed relation to the faces of said second disc, at least one inlet for introducing a slurry material containing particles into the grooves of said first, second and third discs, an outlet for allowing the slurry material to exit the grooves in said first, second and third discs, a drive shaft connected to rotate the second disc, and, a biased connection formed between the first and third discs to allow relative axial, biased movement between the first and third discs under hydraulic pressure from the slurry material.

16. The wet grinding apparatus of claim 15 wherein said biased connection is formed by a plurality of elongated fasteners extending respectively through said first and third discs and springs disposed about said fasteners.

17. Wet grinding apparatus comprising:

first and second discs, each disc having two faces wherein a face of said first disc is in opposed relation to a face of said second disc thereby defining a first pair of opposed faces, a plurality of grooves in each face of said first pair of opposed faces, a drive shaft connected to the second disc for rotating the second disc;

a first fluid inlet path extending through the first disc and leading to the grooves in said first pair of opposed faces for introducing a slurry material containing particles into said grooves of said first pair of opposed faces, a second fluid inlet path extending through the second disc and leading to the grooves in said first pair of opposed faces for introducing additional slurry material containing particles into said grooves of said first pair of opposed faces, and an outlet for allowing said slurry material to exit said grooves.

18. The apparatus of claim 17 wherein the first fluid inlet path includes a plurality of holes extending through the first disc at locations spaced about the drive shaft.

19. The apparatus of claim 17 wherein the second fluid inlet path is created by at least one hole extending through the second disc adjacent the drive shaft.

20. The apparatus of claim 17 wherein the second fluid inlet path is created by a bore extending into the drive shaft and communicating with the grooves in said first pair of opposed faces.

21. Wet grinding apparatus comprising:

a pair of discs mounted to support structure, one disc being mounted for rotation and the other disc being stationary, each disc having a face in opposed relation to a face of the other disc thereby defining a first pair of opposed faces, a plurality of grooves in each face of said first pair of opposed faces, a drive mechanism connected to rotate the rotatable disc;

a fluid inlet in the stationary disc and leading to the grooves in said first pair of opposed faces for introducing a slurry material containing particles into said grooves of said first pair of opposed faces, a collection container having an open end mounted about said fluid inlet and having an inlet for receiving the slurry material, and an outlet for allowing said slurry material to exit said grooves.

22. The apparatus of claim 21 further comprising:

a second stationary disc mounted on an opposite side of the rotatable disc from the first stationary disc to define a second pair of opposed faces, a plurality of opposed grooves in the second pair of opposed faces, and an fluid inlet path leading from said collection container to the opposed grooves in the second pair of opposed faces.

* * * * *